US005918944A

United States Patent [19]

Dietrich

[11] Patent Number: 5,918,944

[45] Date of Patent: Jul. 6, 1999

[54] EIGHT-WAY HAND-TIED RECLINING SEAT

[75] Inventor: David A. Dietrich, Conover, N.C.

[73] Assignee: Classic Leather, Inc., Hickory, N.C.

[21] Appl. No.: 08/979,137

[22] Filed: Nov. 26, 1997

Related U.S. Application Data

[63] Continuation of application No. 08/638,959, Apr. 24, 1996, abandoned.

[51] Int. Cl.[6] ..... A47C 7/24; A47C 7/34

[52] U.S. Cl. ..... 297/452.5; 297/452.51; 297/452.55; 297/68

[58] Field of Search ..... 297/452.48, 452.49, 297/452.5, 452.51, 452.52, 452.53, 452.54, 452.55, 452.1, 75, 68, 85; 267/95; 5/267, 273, 274, 260

[56] References Cited

U.S. PATENT DOCUMENTS

| | | | |
|---|---|---|---|
| 195,454 | 9/1877 | Rodebaugh | 297/452.5 |
| 1,214,415 | 1/1917 | Bero | 5/267 |
| 1,505,025 | 8/1924 | Hilton | 5/267 |
| 1,888,357 | 11/1932 | Oldham | 5/267 |
| 2,107,087 | 2/1938 | Schlachta | 297/452.5 |
| 2,226,040 | 12/1940 | Winders | 5/267 |
| 4,369,534 | 1/1983 | Wright | 267/95 |
| 5,090,768 | 2/1992 | Re et al. | 297/68 |
| 5,374,101 | 12/1994 | Wiecek | 297/75 |
| 5,427,431 | 6/1995 | Saul et al. | 297/68 |
| 5,570,930 | 11/1996 | LaPointe et al. | 297/DIG. 7 |
| 5,582,457 | 12/1996 | Komoroski et al. | 297/75 |

FOREIGN PATENT DOCUMENTS

| | | | |
|---|---|---|---|
| 2123716 | 11/1972 | Germany | 297/452.49 |

*Primary Examiner*—Peter M. Cuomo
*Assistant Examiner*—Anthony D. Barfield
*Attorney, Agent, or Firm*—Rhodes Coats & Bennett, L.L.P.

[57] ABSTRACT

A reclining seat includes a base for mounting on a floor, including left and right arms, left and right recliner mechanisms mounted between the left and right arms, a spring cushion secured between the left and right recliner mechanisms, the spring cushion including support for a plurality springs, a plurality of springs mounted on the support and twine tied in an eight-way, hand-tied pattern to the springs, to provide an eight-way hand-tied cushion for the reclining seat, and upholstery and padding covering the spring cushion.

13 Claims, 5 Drawing Sheets

EIGHT-WAY HAND-TIED RECLINING SEAT

This application is a continuation of Application Ser. No. 08/638,959, filed Apr. 24, 1996, now abandoned.

BACKGROUND OF THE INVENTION

The present invention relates to improvements in reclining seats and tilting seats to permit their upgrading to a higher quality level.

Traditionally, eight-way hand-tied spring coils have been appreciated as the best quality, most long-lasting coils usable in upholstered furniture seats.

Other seat cushion designs have been devised as cost-cutting efforts, but the quality achievable does not rise to the level of eight-way hand-tied spring systems. Among the techniques used are sinuous wire and drop-in grids having coil springs attached at two or three connections. These systems have the advantage of low cost, but sacrifice the comfort and durability of eight-way hand-tied springs.

More recently, motion furniture components have become more commonplace for installation and furniture by furniture manufacturers. An example of recliner mechanisms is depicted in U.S. Pat. No. 4,662,673 to Crum, assigned to Leggett & Platt, Inc., the entire disclosure of which is incorporated hereinabove by reference. Systems such as the Crum system had been used with the sinuous wire and drop-in spring systems for the lower end of the furniture market. However, to applicant's knowledge, these types of recliner mechanisms have never been used with eight-way hand-tied springs for a higher end recliner seat. Accordingly, there exists a need in the art for a seat which has recliner capabilities, but which is made with eight-way hand-tied spring cushion support.

SUMMARY OF THE INVENTION

The present invention fulfills this need in the art by providing a reclining seat including a base for mounting on a floor, including left and right arms, left and right recliner mechanisms mounted between the left and right arms, a spring cushion secured between the left and right recliner mechanisms, the spring cushion including support for a plurality springs, a plurality of springs mounted on the support and twine tied in an eight-way, hand-tied pattern to the springs, to provide an eight-way hand-tied cushion for the reclining seat, and upholstery and padding covering the spring cushion.

In one presently preferred embodiment the reclining seat includes a base for mounting on a floor including left and right side portions, each of which has an inside and an outside, left and right recliner mechanisms mounted to the insides of the left and right side portions, a spring cushion secured to the base between the left and right recliner mechanisms, the spring cushion including support for a plurality springs, a plurality of springs mounted on the support and twine tied in an eight-way, hand-tied pattern to the springs, to provide an eight-way hand-tied cushion for the reclining seat, and upholstery and padding on the base, covering the spring cushion.

Typically, in this embodiment the reclining seat includes upholstered arms attached to the base. Also typically included is a reclining back attached to the left and right recliner mechanisms.

Preferably, the upholstery is leather. The base may be metal and the recliner mechanisms metal secured to the metal base.

In order to provide room for the springs, the spring cushion support includes a plurality of support bars spanning two edges of the base.

The recliner mechanisms may include ottoman supports, and the seat may have an ottoman pad spanning the ottoman supports.

In a second presently preferred embodiment the reclining seat includes a base for mounting on a floor, including left and right arms, left and right recliner mechanisms mounted between the left and right arms, a spring cushion secured to and between the left and right recliner mechanisms, the spring cushion including support for a plurality springs, a plurality of springs mounted on the support and twine tied in an eight-way, hand-tied pattern to the springs, to provide an eight-way hand-tied cushion for the reclining seat, and upholstery and padding covering the spring cushion.

The base may be wood, and the recliner mechanisms metal secured to the wood base.

Preferably, the spring cushion support includes a frame of three peripheral frame elements at right angles to one another so that the frame elements form an open end and a plurality of support bars spanning two of the frame elements and extending parallel to the open end. There may be a reclining back attached to the left and right recliner mechanisms with the open end adjacent the reclining back.

The recliner mechanisms may include medial and distal ottoman supports, with medial and distal ottoman pads spanning the medial and distal ottoman supports to provide a user with leg support when the recliner mechanism is adjusted to a reclined position. The distal ottoman pad folds behind the medial ottoman pad when the recliner mechanisms are contracted.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
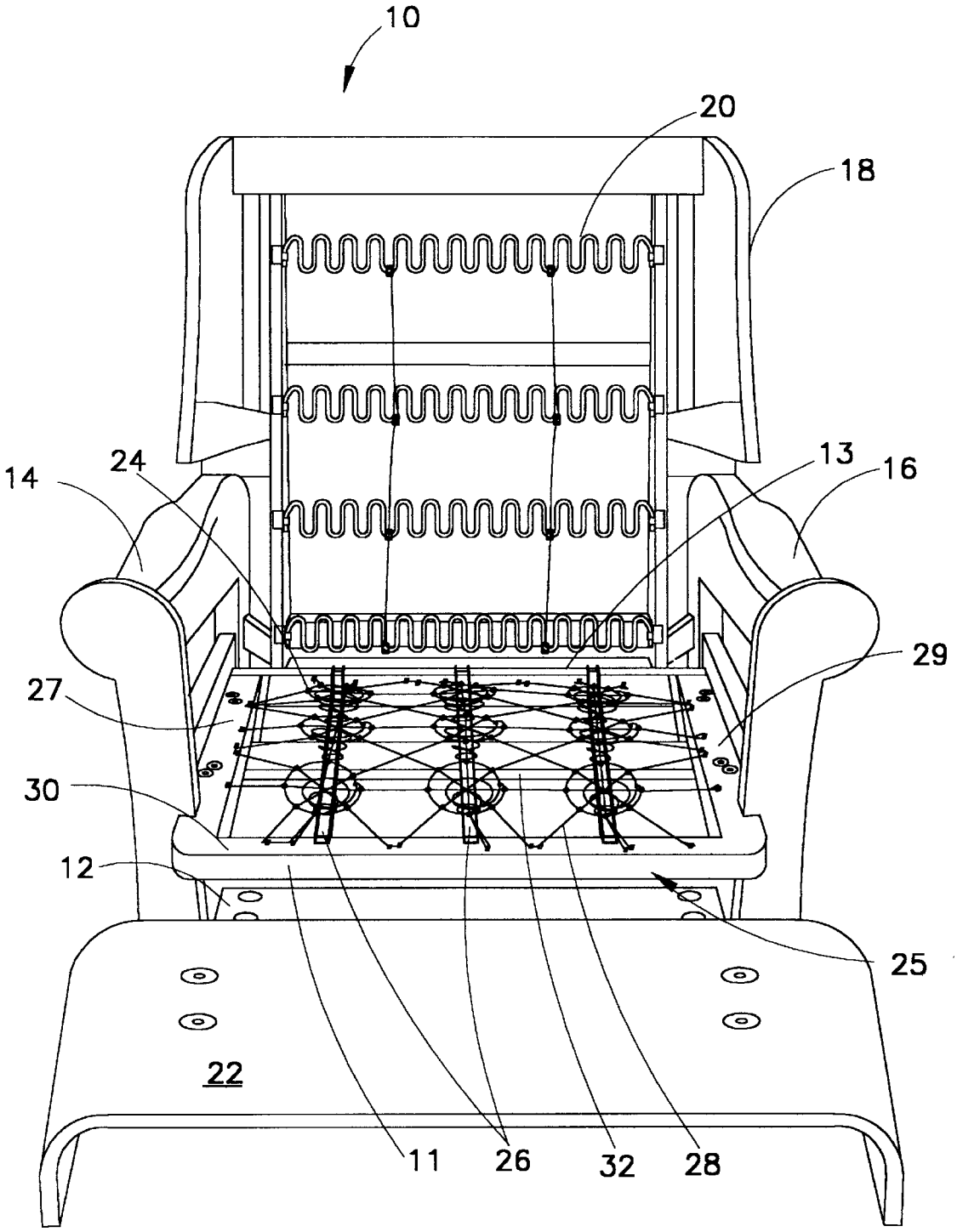
FIG. 1 is a front perspective view of a seat according to a first embodiment of my invention, absent its usual upholstery, to permit the inner structure to be seen.

Referring now to FIG. 1, a seat in the form of a chair 10 is shown. As used herein, the term "seat" is used in its broad sense to include not only chairs, but also loveseats and sofas. The seat 10 shown in FIG. 1 has a base 12, a right arm 14, and a left arm 16, as well as a back 18. The arms 14 and 16 have a peripheral frame 25 mounted to them. Back 18 is provided with sinuous spring 20 because the demands on the back of the seat are less than on the seat portion of the seat, so the eight-way hand-tied assembly is not needed in the back. An ottoman pad 22 is shown extending forwardly of the seat 10. The eight-way hand-tied spring cushion 24 is shown between the arms 14 and 16 supported by frame 25. Extending between the side rails 27,29 of the frame 25 is a lower support brace 32. The support brace 32 in turn provides support for front-to-rear extending rails 26, which are also attached to the front and rear rails 11 and 13 of the peripheral frame 25. Mounted to the rails 26 are individual coil springs 24 tied together in conventional eight-way hand-tied fashion using twine 28. Any suitable flexible material may be substituted for the twine.

The rail 26 is preferably a rail as made by Barber Manufacturing Co., Inc. of Anderson, Ind., and similar to the rail depicted in its U.S. Pat. No. D 348,162.

Figure 2:
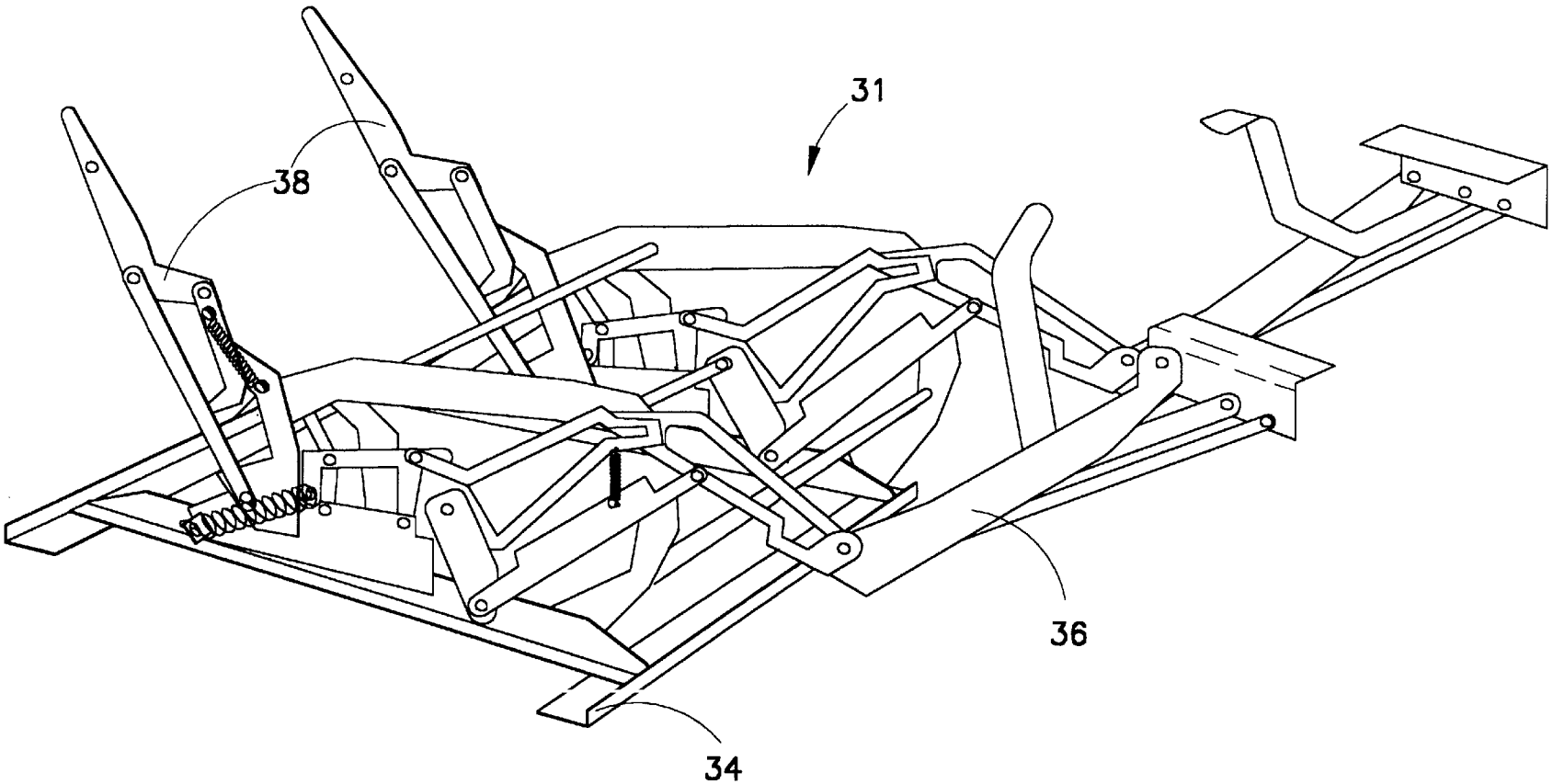
FIG. 2 is a side perspective view of a recliner mechanism for the seat of the embodiment of FIG. 1.

As seen in FIG. 2, the seat 10 is built around a metal recliner mechanism 31. The recliner mechanism 31 includes a base 34 for floor support and ottoman supports 36 to which the ottoman pad 22 is attached as shown in FIG. 1. The back 18 shown in FIG. 1 is attached to the back components 38 of the recliner mechanism 31. Preferably, the recliner mechanism is a Classic Modular Wall Hugger® mechanism marketed by Leggett & Platt, Inc. as covered by its U.S. Pat. No. 4,662,673, mentioned above.

The eight-way hand-tied configuration of the seat is made possible by the mounting of the support brackets 32,26 to the peripheral frame 25 of a size suitable to avoid any collision with the moving apparatus of the recliner mechanism 31. Those of ordinary skill in the art can discern the appropriate sizing to accommodate a particular recliner mechanism and chair style.

Figure 3:
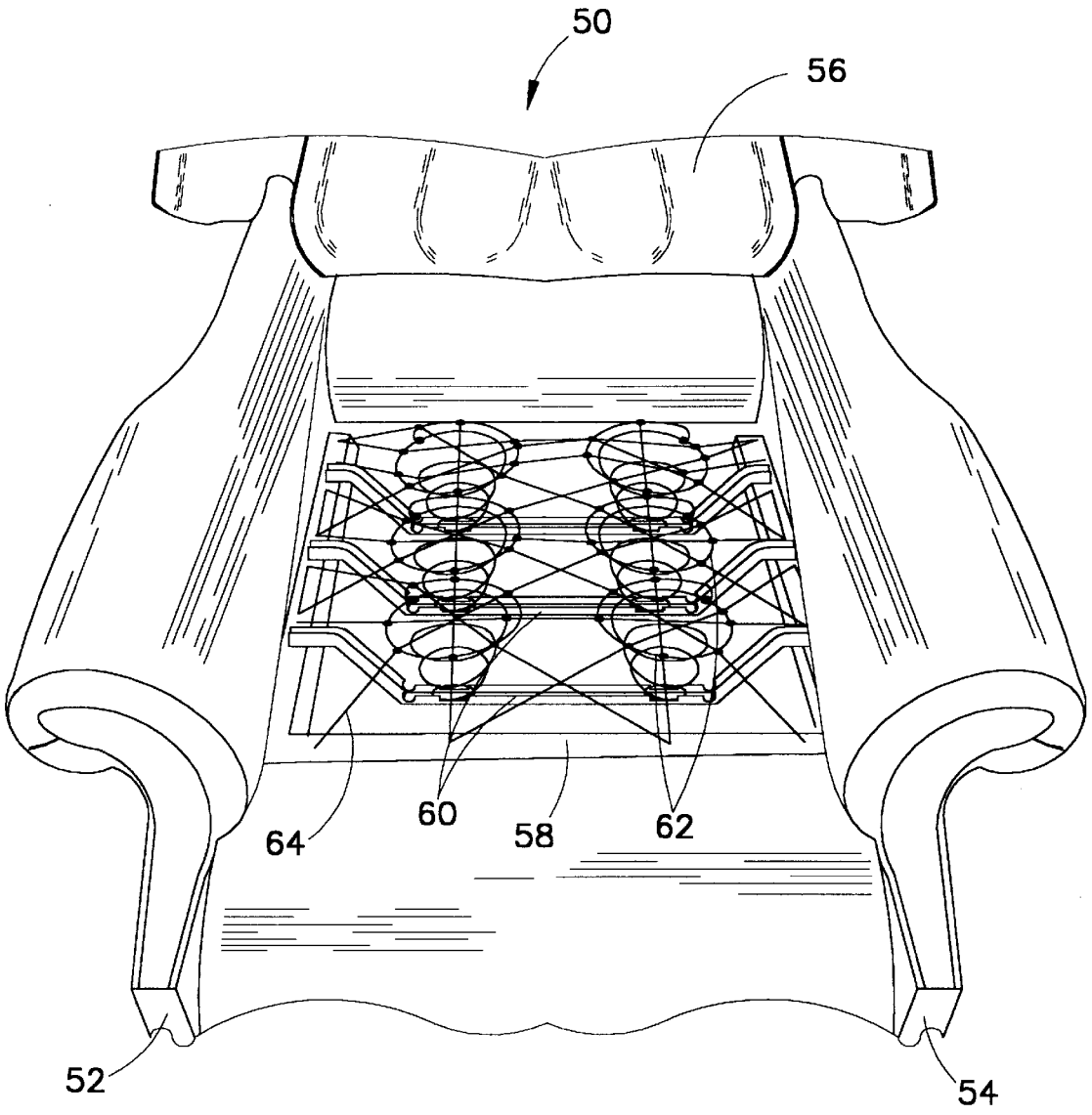
FIG. 3 is a front perspective view of a seat according to a second embodiment of my invention, absent a portion of its usual upholstery, to permit the inner structure to be seen.

Referring now to FIG. 3, a chair according to a second embodiment can be seen. The seat 50 is provided with a right arm 52 and a left arm 54, as well as a reclining back 56. The seat is shown opened absent the upholstery padding and fabric on the seat portion, exposing the eight-way hand-tied spring cushion. As seen in FIG. 3, the cushion 58 includes a plurality of left-to-right extending support rails 60, supporting a plurality of springs 62, tied together according to eight-way hand-tying techniques using twine 64. The cushion 58 and its frame and spring assembly is shown in more detail in FIG. 5.

Figure 4:
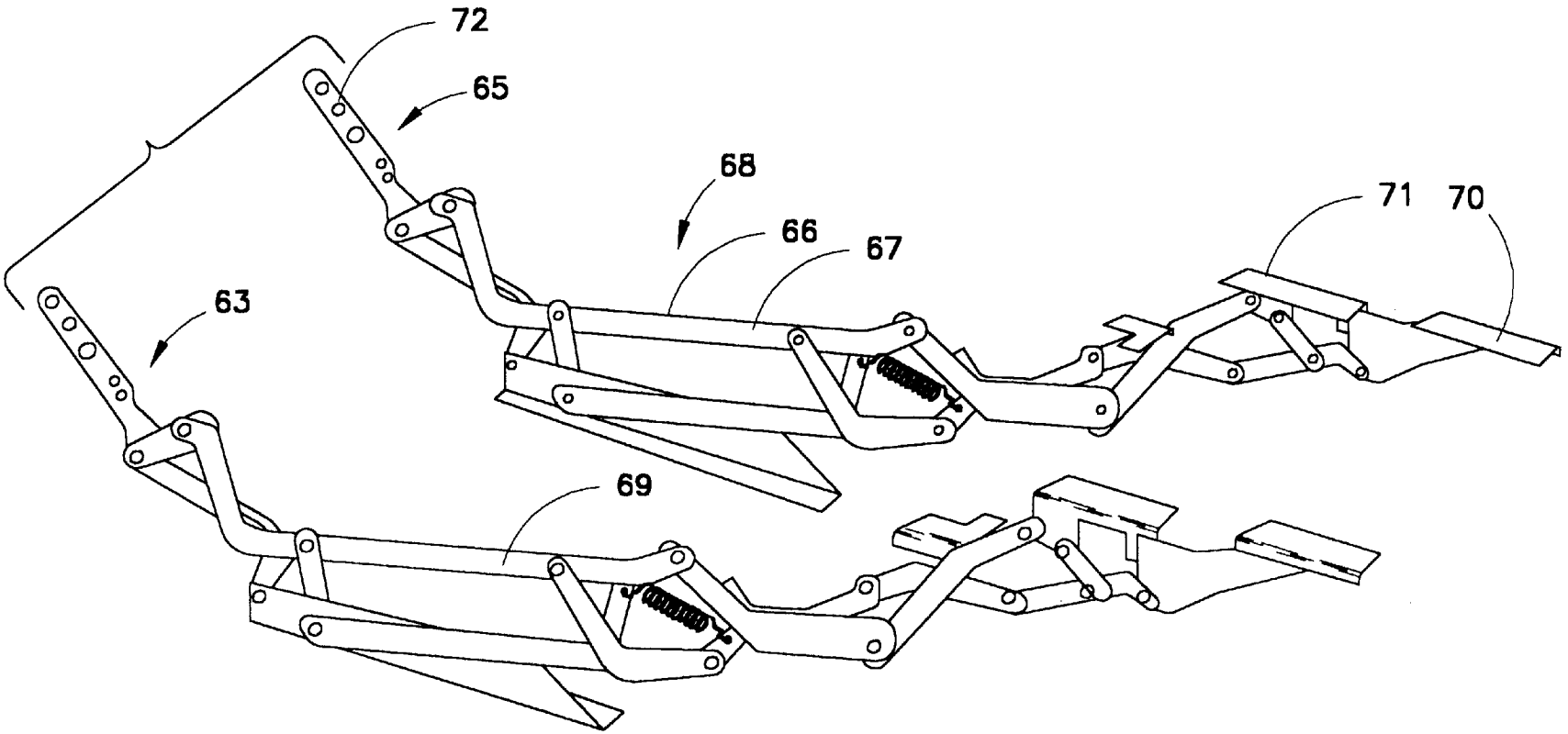
FIG. 4 is a side perspective view of a recliner mechanism for the seat of the embodiment of FIG. 3.

FIG. 4 shows the recliner mechanism 68 suitable for use in the chair 50 of FIG. 3. The mechanism includes a right side portion 63 and a left side portion 65. Preferably, the recliner mechanism is the Leggett & Platt, Inc. three-way Style No. 8550. Each portion 63,65 of the recliner mechanism 68 is made up of a seat portion 66, a distal ottoman support 70, a medial ottoman support 71, and a back support component 72. The recliner is adapted to receive a medial ottoman pad at 71 and a distal ottoman pad at 70, with the distal ottoman pad 70 tucking behind the medial ottoman pad 71 when the seat is returned to a full upright position. Extending between the recliner portions 63,65 is a spring cushion frame support 58 (not shown in FIG. 4) bolted to the right recliner mechanism 63 along bar 69 and to the left recliner mechanism 65 along bar 67.

Figure 5:
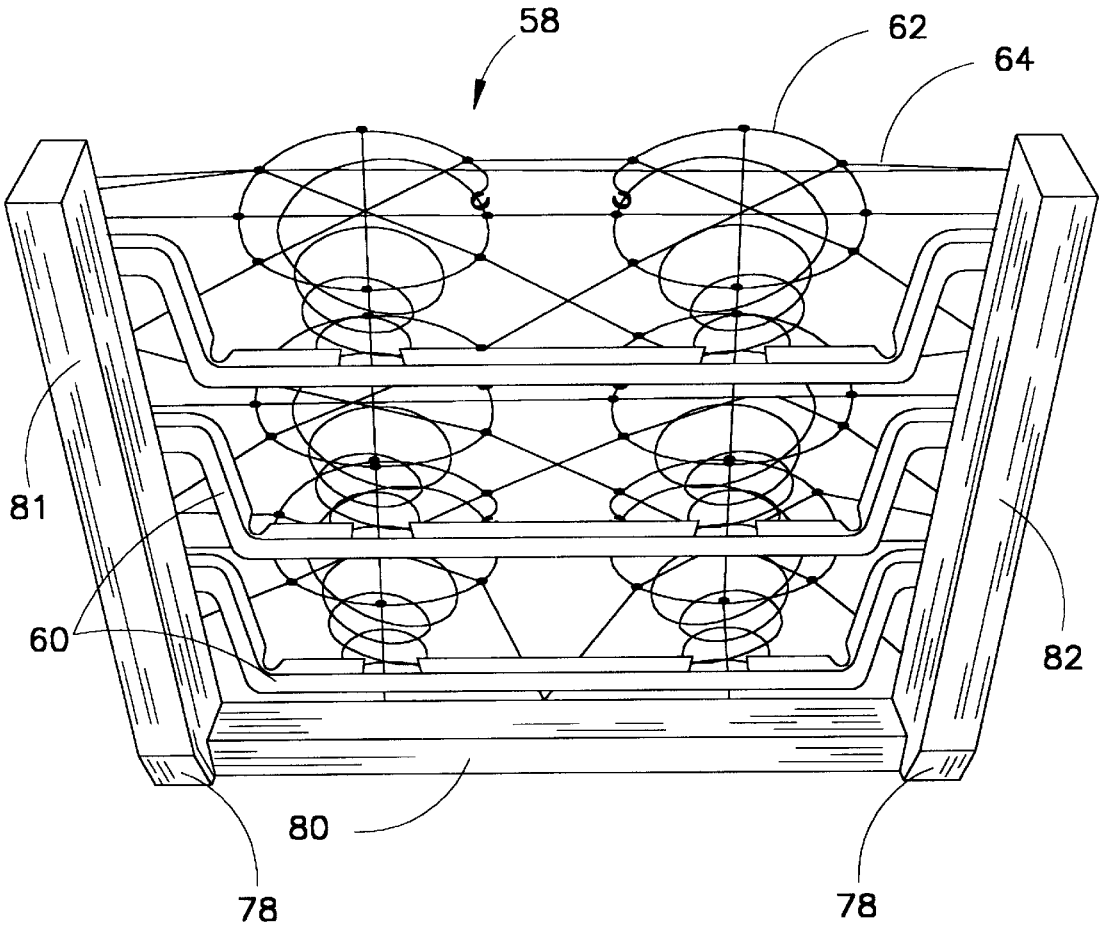
FIG. 5 is a perspective view from behind and below of a spring cushion interior removed from the seat of the embodiment of FIG. 3.

The spring cushion support assembly 58 is shown in FIG. 5, this being the unit bolted between the members 67,69 of FIG. 4. As seen in FIG. 5, from the rear portion of the assembly, three frame elements 80,81,82 are secured together at right angles, forming an open end which is to be mounted to the back of the seat 50 to provide room for movement of the reclining back. Each of the side elements 81,82 is connected by a plurality of left-to-right extending bars 60, configured like the bars 32 of the embodiment of FIG. 1. The bars support springs 62 tied with twine 64 in eight-way hand-tied fashion.

The front element 80 of the frame has reduced height, and the front portions of the side elements 81,82 are chamfered as at 78 to provide room for the return of the ottoman support 70 and an ottoman pad supported thereon.

As can be appreciated, the seat is completed by adding padding to the spring cushion, as well as an upholstery, preferably leather upholstery, although fabric may also be substituted.

As can be appreciated, by use of this invention, an upgrade of recliner quality can be achieved to provide an eight-way hand-tied spring cushion in the seat of the chair, loveseat or sofa, thereby providing the increased comfort and durability obtained with eight-way hand-tied spring cushions.

Those of ordinary skill in the art will appreciate that various modifications to the precise embodiment shown, particularly to seat bodies, can be made by variation of various element sizes and orientations, and the scope of the claims hereof are intended to encompass all such variations.

What is claimed is:

1. A reclining seat comprising a base for mounting on a floor, including left and right arms, left and right recliner mechanisms mounted between said left and right arms, a spring cushion secured between said left and right recliner mechanisms, said spring cushion including a peripheral frame having front, back, right, and left frame members, bars connected to and extending across said frame, a plurality of springs mounted on said bars and twine tied in an eight-way, hand-tied pattern to said springs, to provide an eight-way hand-tied cushion for said reclining seat, wherein said bars include a first set directly connected to the top edge of said front and back frame members and extending underneath said springs, and a second set connected to the underneath edge of said left and right frame members and extending underneath said springs; and upholstery and padding covering said spring cushion.

2. A reclining seat as claimed in claim 1 further comprising upholstered arms attached to said base.

3. A reclining seat as claimed in claim 1 further comprising a reclining back directly attached to said left and right recliner mechanisms.

4. A reclining seat as claimed in claim 1 wherein said upholstery is leather.

5. A reclining seat as claimed in claim 1 wherein said base is metal and said recliner mechanisms are metal secured to said metal base.

6. A reclining seat as claimed in claim 5 wherein said spring cushion support includes a plurality of support bars spanning two edges of said base.

7. A reclining seat as claimed in claim 6 wherein said spring cushion support includes a plurality of support bars spanning two edges of said base.

8. A reclining seat as claimed in claim 1 wherein said recliner mechanisms include ottoman supports and further comprising an ottoman pad spanning said ottoman supports.

9. A reclining seat comprising a base for mounting on a floor, including left and right arms, left and right recliner mechanisms mounted between said left and right arms forming a space therebetween, a spring cushion secured to and between said left and right recliner mechanisms, said spring cushion positioned within said space, a three-sided substantially U-shaped frame having an open end facing the back of said seat, a plurality of springs mounted within said spring cushion, and twine tied in an eight-way, hand-tied pattern to said springs, to provide an eight-way hand-tied cushion for said reclining seat, a plurality of support bars spanning two of said frame elements and supporting said springs, said support bars extending parallel to said frame open end, and upholstery and padding covering said spring cushion.

10. A reclining seat as claimed in claim 9 wherein said base is wood and said recliner mechanisms are metal secured to said wood base.

11. A reclining seat as claimed in claim 10 further comprising a reclining back directly attached to said left and right recliner mechanisms and wherein said open end is adjacent said reclining back.

12. A reclining seat as claimed in claim 9 wherein said recliner mechanisms include medial and distal ottoman supports and further comprising medial and distal ottoman pads spanning said medial and distal ottoman supports to provide a user with leg support when said recliner mechanism is adjusted to a reclined position and wherein said distal ottoman pad folds behind said medial ottoman pad when said recliner mechanisms are contracted.

13. A reclining seat comprising a base for mounting on a floor, including left and right arms, left and right recliner mechanisms mounted between said left and right arms and including medial and distal ottoman supports, said left and right reclining mechanisms being separate and spaced apart to form an inside space, medial and distal ottoman pads spanning said medial and distal ottoman supports to provide a user with leg support when said recliner mechanism is adjusted to a reclined position and wherein said distal ottoman pad folds behind said medial ottoman pad when said recliner mechanisms are contracted, a reclining back directly attached to said left and right recliner mechanisms, a spring cushion positioned within said inside space directly between said left and right reclining mechanisms secured to and between said left and right recliner mechanisms, said spring cushion including support for a plurality of springs in the form of a frame of three peripheral frame elements at right angles to one another so that the frame elements form an open end facing said reclining back and a plurality of support bars spanning two of said frame elements and extending parallel to said open end, a plurality of springs mounted on said support bars and twine tied in an eight-way, hand-tied pattern to said springs, to provide an eight-way hand-tied cushion for said reclining seat, and upholstery and padding covering said spring cushion.

* * * * *